US007901470B2

(12) United States Patent
Graupner et al.

(10) Patent No.: US 7,901,470 B2
(45) Date of Patent: Mar. 8, 2011

(54) GASOLINE ADDITIVES

(75) Inventors: Olaf Graupner, Köfering (DE); Matthias Mundt, Hamburg (DE); Andrea Schütze, Hamburg (DE); Jurgen Jacobus Johannes Louis, Hamburg (DE); David Roy Kendall, Chester (GB); Nigel Peter Tait, Chester (GB)

(73) Assignee: Shell Oil Company, Houston, TX (US)

( * ) Notice: Subject to any disclaimer, the term of this patent is extended or adjusted under 35 U.S.C. 154(b) by 1598 days.

(21) Appl. No.: 10/507,552

(22) PCT Filed: Mar. 14, 2003

(86) PCT No.: PCT/EP03/02822

§ 371 (c)(1),
(2), (4) Date: Apr. 13, 2005

(87) PCT Pub. No.: WO03/076554

PCT Pub. Date: Sep. 18, 2003

(65) Prior Publication Data

US 2005/0172545 A1 Aug. 11, 2005

(30) Foreign Application Priority Data

Mar. 14, 2002 (EP) ..... 02005922

(51) Int. Cl.
*C10L 1/18* (2006.01)

(52) U.S. Cl. ..... 44/412; 44/415

(58) Field of Classification Search ..... 44/412, 44/415

See application file for complete search history.

(56) References Cited

U.S. PATENT DOCUMENTS

| | | | | |
|---|---|---|---|---|
| 3,011,879 | A | 12/1961 | Buckmann et al. | 44/58 |
| 4,836,829 | A | 6/1989 | Zimmerman et al. | 44/53 |
| 5,405,419 | A * | 4/1995 | Ansari et al. | 44/412 |
| 5,855,629 | A | 1/1999 | Grundy et al. | 44/400 |
| 2006/0070293 | A1 * | 4/2006 | Lange et al. | 44/412 |

FOREIGN PATENT DOCUMENTS

| | | |
|---|---|---|
| EP | 0450704 | 10/1991 |
| EP | 0450704 | 1/1994 |
| EP | 0869163 | 10/1998 |
| EP | 1122295 A1 | 10/1999 |
| EP | 1293553 | 3/2003 |
| WO | 90/02782 | 3/1990 |
| WO | WO9010051 | 9/1990 |
| WO | 91/12303 | 8/1991 |
| WO | 01/32812 | 5/2001 |

OTHER PUBLICATIONS

International Search Report dated Jul. 23, 2003.

W.W. Yau, J.J. Kirkland and D.D. Bly, "Modern size exclusion liquid chromatography", John Wiley & Sons, NY, 1979.

* cited by examiner

*Primary Examiner* — Cephia D Toomer

(57) ABSTRACT

The use of an effective concentration of a hydrocarbyl amine wherein the hydrocarbyl moiety has a number average molecular weight in the range 140 to 255 as an additive in an unleaded gasoline composition is provided containing a major proportion of a gasoline suitable for use in a spark ignition engine, for reducing injector nozzle fouling in a direct injection spark ignition engine. A method of operating a direct injection spark ignition engine is also provided.

3 Claims, No Drawings

GASOLINE ADDITIVES

FIELD OF THE INVENTION

This invention relates to gasoline additives, and more particularly to the use of certain amines in unleaded gasoline to impart useful properties.

BACKGROUND OF THE INVENTION

U.S. Pat. No. 3,011,879, published in 1961, describes gasoline compositions containing $C_{12}$ to $C_{22}$ linear aliphatic amines, e.g. dodecylamine, for the reduction of carburettor and other deposits, including intake (inlet) valve deposits, preferably in combination with a hydrocarbon oil and/or a metal deactivator such as a condensation product of a salicylaldehyde with an aliphatic polyamine, preferably an aliphatic diamine. The amount of amine used is between about 0.00004% and 0.02% by weight (Col. 3 lines 44 to 46) (i.e. between 0.4 ppm and 200 pm). Although it is said that the gasoline can be "with or without soluble lead compounds", all of the gasolines of the examples (Col. 5 line 43 to Col. 9 line 57) are leaded gasolines, and the engine tests use engines with carburettors.

Modern gasolines are unleaded in order to be compatible with catalytic convertors, and fuel injection has to be used in modern spark ignition engines, in order to achieve the required stoichiometric fuel/air mixtures. A typical fuel-injected spark ignition engine has multipoint fuel injection (MPFI), in which fuel from the injectors impinges directly onto inlet valves. An unleaded base gasoline in such an engine tends to give rise to inlet valve deposits, and additives have been developed to reduce or minimise these deposits. Addition of low molecular weight aliphatic amines such as dodecylamine makes no difference to the formation of such deposits, as will be illustrated in comparative examples later in this specification.

EP-A-450 704 (Shell), published in 1991, described the use of $C_{10}$ to $C_{20}$ linear alkylamines, e.g. dodecylamine, as a diesel fuel additive for reducing fouling of injectors in diesel (compression ignition) engines. EP-A-450 704 specifically describes tests in an indirect injection diesel engine showing the beneficial effect in a typical blended diesel oil of the time, in accordance with BS 2869.

Although dodecylamine worked well with diesel oils of that time, those had relatively high sulphur content. With reduction of sulphur content from typical levels of about 2000 ppmw to 500 ppm or less, not only did the properties of the fuel change so that lubricity enhancers had to be incorporated in diesel fuel, but it was found (for reasons unknown) that dodecylamine failed to be effective in reducing fouling of injectors in diesel engines operating on low-sulphur fuels. Accordingly, use of dodecylamine in diesel fuel ceased, and the national patents issuing from EP-B-450 704 have been allowed to lapse.

Modern gasolines are inherently low-sulphur fuels, e.g. containing less than 150 ppmw sulphur.

A relatively new class of spark ignition engines is the class described as direct injection spark ignition (DISI) engines (also known as gasoline direct injection (GDI) engines).

SUMMARY OF THE INVENTION

It has now surprisingly been discovered that incorporation of a relatively low molecular weight hydrocarbyl amine, such as dodecylamine, in an unleaded gasoline composition can result in prevention of deposits or even clean-up of existing nozzle fouling in injectors of a DISI engine when the gasoline compositon is used in such an engine.

According to the present invention therefore there is provided the use of an effective concentration of a hydrocarbyl amine wherein the hydrocarbyl moiety has a number average molecular weight in the range 155 to 255 as an additive in an unleaded gasoline composition comprising a major proportion of a gasoline suitable for use in a spark ignition engine, for reducing injector nozzle fouling in a direct injection spark ignition (DISI) engine.

DETAILED DESCRIPTION OF THE INVENTION

Number average molecular weight of hydrocarbons, e.g. polyalkenes, may be determined by several techniques which give closely similar results. Conveniently, Mn may be determined for example by vapour phase osmometry (VPO) (ASTM D 3592) or by modern gel permeation chromatography (GPC), e.g. as described for example in W. W. Yau, J. J. Kirkland and D. D. Bly, "Modern Size Exclusion Liquid Chromatography", John Wiley and Sons, New York, 1979. Where a hydrocarbyl amine is a discrete chemical compound, e.g. dodecylamine, the number average molecular weight can be calculated as its formula weight (e.g. 155 for decyl, 169 for dodecyl, 253 for octadecyl).

Whilst the amine component of the hydrocarbyl amine may be a monoamine or a polyamine (e.g. N-dodecyl-1,2-diaminoethane), the hydrocarbyl amine is preferably a monoamine, more preferably a primary monoamine.

The hydrocarbyl moiety may contain one or more sites of ethylenic unsaturation. However, more conveniently the hydrocarbyl moiety is a saturated hydrocarbyl moiety. Whilst the hydrocarbyl moiety may be linear or branched, linear hydrocarbyl amines have been found to be very effective.

Preferably the hydrocarbyl amine comprises at least one linear alkylamine of formula $$CH_3(CH_2)_nNH_2 \quad (I)$$

Wherein n is 9 to 17, preferably 9 to 15, more preferably 11 to 15. Dodecylamine has been found to be particularly effective.

The hydrocarbyl amines are all either known materials or may be prepared in analogous manner to known materials, as will be readily understood by those skilled in the art.

What constitutes an effective concentration of hydrocarbyl amine may be established by routine engine testing, as will be apparent to those skilled in the art, and optimal concentration of one hydrocarbyl amine may be different from that of another hydrocarbyl amine. However, amounts of the hydrocarbyl amine may, generally be in the range 10 to 5000 ppmw of the gasoline composition. Preferably the hydrocarbyl amine comprises 10 to 1000 ppmw of the gasoline composition, more preferably 20 to 750 ppmw. Concentrations in the range 50 to 500 ppmw have been found to be very effective.

Those skilled in the art will appreciate that where a DISI engine is run regularly on gasoline containing the hydrocarbyl amine, for "keep clean" purposes, the optimal effective concentration of hydrocarbyl amine may be lower than when an occasional tankful of gasoline containing the hydrocarbyl amine is used for "clean up" purposes (with the DISI engine being run on conventional unleaded gasoline between times).

Use in accordance with the present invention can be regarded as use of an effective concentration of the hydrocarbyl amine for reducing injector nozzle fouling in the DISI engine compared with a unleaded gasoline composition which is the same composition except that it does not contain hydrocarbyl amine.

The present invention further provides a method of operating a direct injection spark ignition engine with reduced fouling of injector nozzles, which comprises running the engine on an unleaded gasoline composition containing a major proportion of gasoline suitable for use in a spark ignition engine and an effective concentration of a hydrocarbyl amine wherein the hydrocarbyl moiety has a number average molecular weight in the range 155 to 255, as defined above.

The hydrocarbyl amine may (already) be incorporated in a gasoline composition (when it is) delivered into a vehicle fuel tank from a fuel pump at a filling station. Alternatively, a measured quantity of the hydrocarbyl amine, either as neat amine, or, more conveniently, in association with a gasoline-compatible carrier or diluent, may be introduced into the fuel present in the fuel tank of a vehicle powered by a DISI engine. This may be done regularly, for "keep clean" purposes, or (usually at a higher concentration) occasionally for "clean up" following a period of running on gasoline which does not contain hydrocarbyl amine wherein the hydrocarbyl moiety has a number average molecular weight in the range 140 to 255.

Accordingly, another aspect of the present invention provides a method of curing or preventing fouling of injector nozzles in a direct injection spark ignition engine which comprises introducing into gasoline in the fuel tank of a vehicle provided with a direct injection spark ignition engine (e.g. when refuelling the vehicle, or when the vehicle is in a servicing centre for routine servicing (maintenance) or repair) a formulation comprising a hydrocarbyl amine wherein the hydrocarbyl moiety has a number average molecular weight in the range 155 to 255 in association with a gasoline-compatible carrier or diluent. Suitable such carriers and diluents are well known to those skilled in the art, and are described, for example, in WO 0132812.

Typical of gasolines suitable for use in spark ignition engines, which may be used in unleaded gasoline compositions, are mixtures of hydrocarbons having boiling points in the range from 25° C. to 232° C. and comprising mixtures of saturated hydrocarbons, olefinic hydrocarbons and aromatic hydrocarbons. Preferred are gasoline blends having a saturated hydrocarbon content ranging from 40 to 80 percent volume, an olefinic hydrocarbon content ranging from 0 to 30 percent volume and an aromatic hydrocarbon content ranging from 10 to 60 percent volume. The gasoline can be derived from straight run gasoline, polymer gasoline, natural gasoline, dimer or trimerised olefins, synthetically produced aromatic hydrocarbon mixtures from thermally or catalytically reformed hydrocarbons, or from catalytically cracked or thermally cracked petroleum stocks, or mixtures of these. The hydrocarbon composition and octane level of the gasoline are not critical. The octane level, (R+M)/2, will generally be above 85. Any conventional gasoline can be used, for example, in the gasoline, hydrocarbons can be replaced by up to substantial amounts of conventional alcohols or ethers, conventionally known for use in gasoline. Alternatively, e.g. in countries such as Brazil, the "gasoline" may consist of essentially of ethanol. The gasoline preferably contains less than 150 ppmw sulphur.

The gasoline must be lead-free, but can contain minor amounts of blending agents such as methanol, ethanol and methyl tertiary butyl ether (MTBE), e.g. from 0.1 to 15% volume of the gasoline.

The unleaded gasoline composition may additionally contain one or more antioxidants, dyes, corrosion inhibitors, metal deactivators, dehazers, lead-free anti-knock compounds, carrier fluids, diluents, and/or detergents (dispersants), e.g. as described in WO 0132812 or U.S. Pat. No. 5,855,629.

A good quality gasoline composition for use in conventional single point or multipoint gasoline injection engines may typically include a high molecular weight nitrogen-containing detergent containing a hydrocarbyl group having a number average molecular weight (Mn) in the range 750 to 6000.

Such detergents may be amines, e.g. a polyisobutylene mono-amine or polyamine, such as a polyisobutylene ethylenediamine or N-polyisobutenyl-N',N'-dimethyl-1,3-diaminopropane, or amides, e.g. a polyisobutenyl succinimide, and are variously described in U.S. Pat. No. 5,855,629 and WO 0132812.

Uses in accordance with the invention, and methods in accordance with the invention, therefore preferably employ a gasoline composition which additionally contains 50 to 2000 ppmw based on the gasoline composition of a high molecular weight nitrogen-containing detergent containing a hydrocarbyl group having a number average molecular weight in the range 750 to 6000.

Since such a gasoline composition can be used in all forms of spark ignition engine, the present invention therefore further provides an unleaded gasoline composition suitable for use in accordance with the invention, which comprises a major proportion of a gasoline suitable for use in a spark ignition engine, 10 to 1000 ppmw based on the gasoline composition of a hydrocarbyl amine having a number average molecular weight in the range 155 to 270, and 50 to 2000 ppmw based on the gasoline composition of a high molecular weight nitrogen-containing detergent containing a hydrocarbyl group having a number average molecular weight in the range 750 to 6000.

A particularly preferred high molecular weight nitrogen-containing detergent is a high molecular weight hydrocarbyl amine of formula R"—$NH_2$— wherein R" represents a group R" or a group R"—$CH_2$—. R" preferably represents a hydrocarbyl group having a number average molecular weight in the range 900 to 3000, more preferably in the range 950 to 2000, and most preferably in the range 950 to 1350, e.g. a polybutenyl or polyisobutenyl group having a number average molecular weight in the range 950 to 1050.

The high molecular weight nitrogen-containing detergents are known materials and may be prepared by known methods or by methods analogous to known methods. For example, U.S. Pat. No. 4,832,702 describes the preparation of polybutenyl- and polyisobutenyl amines from an appropriate polybutene or polyisobutene by hydroformylation and subsequent amination of the resulting oxo product under hydrogenating conditions.

Suitable high molecular weight hydrocarbyl amine are obtainable from BASF A.G. under the trade marks "Keropur" and "Kerocom".

The invention will be further understood from the following illustrative examples, in which, unless otherwise indicated, parts and percentages are by weight, and the temperatures are in degrees Celsius.

Fuel samples were prepared in conventional manner, using as base fuel an unleaded gasoline (95 ULG) of RON 96.2, MON 85.1, and having a sulphur content (DIN EN ISO 14596) of 0.01% w/w, aromatics content (DIN 51413/T3) 37.3% v/v, density (DIN 51757/V4) 750.4 kg/$m^3$, a 10% v/v distillation temperature of 45.9° C., a 50% v/v distillation temperature of 101.7° C., a 90% v/v distillation temperature of 160.7° C. and a final distillation temperature of 194.7° C.

Four different types of fuel sample were used: —

Fuel A was the base fuel per se,

Fuel B was fuel prepared by dosing into the base fuel 645 ppmw of a commercial additive package ex BASF A.G., containing polyisobutylene monoamine (PIBA), in which the polyisobutylene (PIB) chain has a number average molecular weight (Mn) of approximately 1000, a polyether carrier fluid and an antioxidant, Fuel C was fuel prepared by dosing into the base fuel 50 ppmw dodecylamine (laurylamine), and Fuel D was the same as Fuel B, with the further inclusion of 50 ppmw dodecylamine.

Fuels A, B, C and D were tested in a direct injection spark ignition (DISI) engine (also known as gasoline direct injection (GDI) engine) and in a conventional multipoint fuel injection (MPFI) (also known as port fuel injection) spark ignition engine as follows.

DISI Engine Test

The DISI engine used was a Mitsubishi 4-cylinder 1.84 liter GDI engine from a 1997 Mitsubishi Carisma GDI automobile, having cylinder dimensions of 81 mm bore, 89 mm stroke and compression ratio 12.5:1.

In this test, injector nozzle fouling was investigated in bench engine testing. Before each test, pre-measured clean or dirty injectors were fitted to the engine (according to whether fouling/keep clean or clean-up was being assessed). Inlet parts and combustion chambers were not cleaned, but new spark plugs were fitted and a new fuel filter was used. All fuel pipes and the fuel tank were flushed with 30 l of fresh fuel. A new oil filter was fitted and the engine was filled with new engine oil ("Shell Helix Ultra 5W-30") (trade mark). Before the start of each test, a pre-test check run was made to ensure that the engine was operating correctly.

The engine test procedure was based on the CEC F-05-A-93 procedure for the Mercedes Benz M 102E engine, with the third stage modified to maximise lean operation of the engine. The standard test duration was 120 hours (1600 test cycles). During the test the manufacturer's standard blow-by system was used, whereby blow-by was delivered to the rear mounted valve of the pair of inlet valves for each cylinder.

The specific conditions of each cycle were: —

| Stage | time (sec) | rpm | torque (nm) | coolant temp. (° C.) |
|---|---|---|---|---|
| 1 | 30 | 550 | 0 | 90 (±3) |
| 2 | 60 | 1300 | 28 | 90 (±3) |
| 3 | 120 | 1650 | 26 | 90 (±3) |
| 4 | 60 | 3000 | 34 | 90 (±3) |

Upon completion of the test, the inlet injectors were removed and dried in a vacuum oven, after which the diameter of the injector nozzle was measured. Reduction in nozzle diameter was calculated and expressed as a percentage reduction relative to the clean nozzle.

In the examples and comparative examples, fouling tests were effected (comparative examples A and B) and clean-up (Example 1) and keep-clean (Example 2) tests. Results are given in Table 1 following: —

TABLE 1

| Example | Fuel | Test Duration | Average Injector Diameter Reduction (%) Start | End |
|---|---|---|---|---|
| Comp. A | A | 120 hours | 0 | 7 |
| Comp. B | B | 88 hours | 0 | 6 |
| 1 | D | 21 hours | 6 | 0 |
| 2 | C | 78 hours | 0 | 0 |

In Comp. B, the test was stopped after 88 hours due to operational problems with the engine (engine stopped due to low idle speed). In Example 1 the 21 hours corresponded to 2 tank fillings (50 l fuel per filling), and total clean-up was achieved. In Example 2, operational problems with the engine again resulted in reduced test duration; however, the injectors had remained completely clean.

Reduction of nozzle diameter of 7% has been found to result in drop in power of 10% wt high load and impaired driveability.

MPFI Engine Test

The MPFI engine used was a Daimler Chrysler M111 4-cylinder 2.0 liter MPFI engine, having cylinder dimensions of 89.9 mm bore, 78.7 mm stroke and compression ratio 9.6:1.

In this test, inlet valve fouling was investigated in bench engine testing. The fuel injectors in an MPFI engine are in a relatively cool environment, so injector fouling is not a problem, but fuel from the injectors impinges directly onto the inlet valves, with the potential to lead to problems stemming from inlet valve deposits.

Before each test spark plugs, fuel filter, inlet valves, valve stem seals, oil filter and cylinder head gasket and seals were replaced with new ones, the inlet valves being pre-weighed, and combustion chambers were cleaned of deposits. All fuel pipes and the fuel tank were flushed with 30 l of fresh fuel. A new oil filter was fitted, and the engine was filled with new engine oil ("Shell Helix Ultra 5W-30") (trade mark). Before the start of each test, a pre-test check run was made to ensure that the engine was operating correctly.

The engine test procedure was based on the CEC F-05-A-93 procedure for the Mercedes Benz M102 engine. The manufacturer's standard blow-by system was used, whereby blow-by is distributed only to cylinders 1 and 4. The inlet valves were pegged to prevent rotation. Test duration was 60 hours (800 test cycles).

The specific conditions of each cycle were: —

| Stage | time (sec) | rpm | torque (nm) | coolant temp. (° C.) |
|---|---|---|---|---|
| 1 | 30 | 800 | 0 | 105 (±5) |
| 2 | 60 | 1500 | 40 | 105 (±5) |
| 3 | 120 | 2500 | 40 | 105 (±5) |
| 4 | 60 | 3800 | 40 | 105 (±5) |

Upon completion of the test, the engine was stripped and the inlet valves were rinsed with n-heptane. Deposits were then carefully removed from the surfaces of the valves facing the combustion chamber and the valves were weighed. The weight differences relative to the pre-weighed valves were then calculated and averaged.

Results for these comparative examples are given in Table 2 following: —

TABLE 2

| Example | Fuel | Test Duration | Average deposits/inlet valve (mg) |
|---|---|---|---|
| Comp C | A | 120 hours | 322 |
| Comp E | C | 120 hours | 322 |
| Example 3 | D | 120 hours | 209 |

The results show that in a MPFI spark ignition engine, addition of dodecylamine to base fuel makes no difference to inlet valve deposits, but that fuel containing a combination of dodecylamine and high molecular weight ashless dispersant can result in reduced inlet valve deposits relative to base fuel or gasoline containing dodecylamine but no high molecular weight ashless dispersant.

Those skilled in the art will appreciate from Examples 1 and 2 that the dodecylamine can be incorporated in a gasoline composition delivered from a fuel pump at a filling station, or it may be added, either as neat dodecylamine, or, more conveniently, in association with a gasoline-compatible carrier or diluent, in a measured quantity into the fuel present in the fuel tank of a vehicle powered by a direct ignition spark ignition engine, e.g. for clean-up following a period of running on standard pump fuel which does not contain dodecylamine.

Tests in an experimental direct injection spark ignition engine resulted in complete clean up of foul injector nozzles after running on one 34 litre tank of unleaded gasoline to which had been added dodecylamine in an amount to give a dodecylamine concentration of 500 ppmw.

Conveniently, therefore, a car servicing centre can add a suitable amount of dodecylamine to the fuel tank of a vehicle powered by a direct injection spark ignition engine when the vehicle is in the servicing centre for routine engine oil change or other servicing (maintenance) or repair.

The invention claimed is:

1. A method of operating a direct injection spark ignition engine with reduced fouling of injector nozzles, which comprises running the engine on an unleaded gasoline composition comprising a major proportion of a gasoline suitable for use in a spark ignition engine, 10 to 1000 ppmw based on the gasoline composition of a hydrocarbyl primary monoamine having a number average molecular weight in the range 155 to 270, and 50 to 2000 ppmw based on the gasoline composition of a high molecular weight nitrogen-containing detergent containing a hydrocarbyl group having a number average molecular weight in the range 750 to 6000, wherein the hydrocarbyl primary monoamine comprises at least one linear alkylamine of formula $$CH_3(CH_2)_nNH_2 \quad (I)$$

wherein n is 9 to 17.

2. A method of operating a direct injection spark ignition engine with reduced fouling of injector nozzles, which comprises running the engine on an unleaded gasoline composition comprising a major proportion of a gasoline suitable for use in a spark ignition engine, 20 ppmw to 750 ppmw based on the gasoline composition of a hydrocarbyl primary monoamine having a number average molecular weight in the range 155 to 270, and 50 to 2000 ppmw based on the gasoline composition of a high molecular weight nitrogen-containing detergent containing a hydrocarbyl group having a number average molecular weight in the range 750 to 6000 wherein the hydrocarbyl primary monoamine comprises at least one linear alkylamine of formula $$CH_3(CH_2)_nNH_2 \quad (I)$$

wherein n is 9 to 17.

3. The method of claim 2 wherein in formula I n is 11 to 15.

* * * * *